US005997189A

United States Patent [19]

Nakamura et al.

[11] Patent Number: 5,997,189

[45] Date of Patent: Dec. 7, 1999

[54] AUTOMATIC DEVELOPER FOR PHOTOSENSITIVE MATERIAL

[75] Inventors: Yoshifumi Nakamura; Hisashi Negoro, both of Wakayama, Japan

[73] Assignee: Noritsu Koki Co., Ltd., Wakayama-ken, Japan

[21] Appl. No.: 09/194,498

[22] PCT Filed: Apr. 10, 1998

[86] PCT No.: PCT/JP98/01658

§ 371 Date: Nov. 25, 1998

§ 102(e) Date: Nov. 25, 1998

[87] PCT Pub. No.: WO98/01658

PCT Pub. Date: Oct. 15, 1998

[30] Foreign Application Priority Data

Apr. 10, 1997 [JP] Japan ..... 9-92598

[51] Int. Cl.[6] ..... G03D 3/02; G03D 3/08

[52] U.S. Cl. ..... 396/565; 396/622; 396/626; 396/630

[58] Field of Search ..... 396/565, 617, 396/620, 622, 624, 626, 630

[56] References Cited

U.S. PATENT DOCUMENTS 5,341,189 8/1994 Helfer et al. ..... 396/630

5,526,087 6/1996 Suzuki et al. ..... 396/630

5,633,697 5/1997 Kinoshita ..... 396/626

5,852,755 12/1998 Nakashima ..... 396/626

*Primary Examiner*—Alan A. Mathews

*Attorney, Agent, or Firm*—Jordan and Hamburg LLP

[57] ABSTRACT

A liquid channel (411*a*) is formed in an upper end of a partition wall (411) between subtanks (41) and (42) each filled with a fixing liquid to draw the fixing liquid from the subtank (42) into the subtank (41), and a guide plate including an opposing plate (411*d*) is provided in the subtank (41) to guide the fixing liquid downward. A liquid channel (431*a*) is formed in an upper end of a partition wall (431) between subtanks (43) and (44) each filled with a stabilizing liquid to draw the stabilizing liquid from the subtank (44) into the subtank (43), and a guide plate including an opposing plate (431*d*) is provided in the subtank (43) to guide the stabilizing liquid downward. A liquid channel (441*a*) is formed in an upper end of a partition wall (441) between subtanks (44) and (45) each filled with a stabilizing liquid, and a guide plate including an opposing plate (441*d*) is provided in the subtank (44).

9 Claims, 12 Drawing Sheets

AUTOMATIC DEVELOPER FOR PHOTOSENSITIVE MATERIAL

FIELD OF THE INVENTION

The present invention relates to an automatic developing system of developing a photographic sensitized material (simply referred to as "a sensitized material" hereinafter) by feeding a roll of sensitized material such as photographic film and photographic printing paper in a treating tank filled with a treating liquid.

BACKGROUND ART

Conventionally, there has been known an automatic developing system of developing a photographic sensitized material provided with a series of treating tanks each filled with a certain treating liquid therein in the order from upstream to downstream in the direction of feeding the sensitized material, e.g., a developing tank filled with a developing liquid, a bleaching tank filled with a bleaching liquid, a fixing tank filled with a fixing liquid, and a stabilizing tank filled with a stabilizing liquid. In such an automatic developing system, subtanks such as a developing subtank filled with a developing liquid, a bleaching subtank filled with a bleaching liquid, a fixing subtank filled with a fixing liquid, and a stabilizing subtank filled with a stabilizing liquid are provided in such a manner as to communicate with the corresponding treating tank in order to circulate the treating liquid in the communicating treating tank and the subtank.

In particular, a plural number of fixing tanks and stabilizing tanks and a plural number of fixing subtanks and stabilizing subtanks are provided to suppress contamination of the fixing liquid and the stabilizing liquid by the treating liquid that has been adhered to the surface of the sensitized material in the process prior to the fixing/stabilizing process.

Fresh developing liquid and bleaching liquid are replenished into the developing subtank and the bleaching subtank respectively, and the developing liquid and the bleaching liquid in the respective treating tanks are drained outside. More specifically, the fixing subtank and the stabilizing subtank that are located on the downstream in the feeding direction are replenished with fresh fixing liquid and stabilizing liquid, respectively, and the fixing liquid and the stabilizing liquid are drained from the fixing tank and the stabilizing tank that are located on the upstream side, respectively. Thereby, the fixing liquid and the stabilizing liquid in the downstream subtank flow into the upstream subtank.

In the automatic developing system having the above construction, a transport rack is provided in each of the treating tanks to feed the roll of sensitized material from upstream to downstream in the treating tanks each filled with a treating liquid to sequentially perform a developing operation.

Observing the fixing tank/subtank, the bleaching liquid having a greater specific gravity than the fixing liquid is adhered to the surface of the sensitized material in the bleaching tank and carried into the fixing tank. Accordingly, the upstream fixing tank/subtank, which are closer to the bleaching tank, contain the fixing liquid having a greater specific gravity than the downstream fixing tank/subtank. When the fixing liquid having a smaller specific gravity in the downstream fixing subtank flows into the upstream fixing subtank through the liquid level, the lighter fixing liquid supplied from the downstream fixing subtank does not mix well with the heavier fixing liquid in the upstream fixing subtank due to the specific gravity difference.

The above phenomenon also occurs in the stabilizing tank and the stabilizing subtank. The fixing liquid having a greater specific gravity than the stabilizing liquid is adhered to the surface of the sensitized material in the fixing tank and carried into the stabilizing tank. Accordingly, the upstream stabilizing tank/subtank, which are closer to the fixing tank, contain the stabilizing liquid having a greater specific gravity than the downstream stabilizing tank/subtank. When the stabilizing liquid having a smaller specific gravity in the downstream stabilizing subtank flows into the upstream stabilizing subtank through the liquid level, the lighter stabilizing liquid supplied from the downstream stabilizing subtank does not mix well with the heavier stabilizing liquid in the upstream stabilizing subtank due to the specific gravity difference.

In order to prevent the above drawbacks, the conventional system is constructed such that a partition wall provided between the adjacent subtanks is formed with a through hole in a vertically intermediate portion thereof, and a liquid supply pipe is provided in the through hole to flow the treating liquid from the downstream subtank into the middle or a lower portion of the upstream subtank through the pipe with an attempt to mix the lighter treating liquid flowing from the downstream subtank with the heavier treating liquid in the upstream subtank.

The above idea of providing the pipe in the intermediate through hole in the partition wall separating the adjacent subtanks, however, is cumbersome in the aspect of plumbing operation. Further, in the case of integral molding of the treating tank and the subtank with a synthetic resin or its equivalent, the construction of a mold for the treating tank/subtank would be complex, because the through hole is formed in the vertically intermediate portion of the partition wall. This would raise the production cost of the system.

The present invention has been accomplished in view of the foregoing problems in the prior art and an object thereof is to provide an automatic developing system of developing a sensitized material that securely enables mixing of a treating liquid with a lighter specific gravity flowing from a downstream subtank with a treating liquid with a heavier specific gravity in an upstream subtank with a simple construction.

DISCLOSURE OF THE INVENTION

To accomplish the above objects, an automatic developing system of developing a photographic sensitized material, according to an aspect of this invention, is provided with a first treating tank and a second treating tank each filled with the same kind of treating liquid therein and arranged sequentially from an upstream side to a downstream side in a feeding direction of the sensitized material, a first subtank and a second subtank each filled with the same kind of treating liquid as the first treating tank and the second treating tank therein and communicating with the first treating tank and the second treating tank, respectively side by side, a supplier means for supplying the treating liquid in each of the first subtank and the second subtank to the corresponding treating tank via a filter provided in the subtank, and a liquid channel formed between the first subtank and the second subtank to flow the treating liquid from the second subtank into the upstream first subtank therethrough by replenishing fresh treating liquid from an external source into the downstream second subtank. The system is characterized in that the liquid channel is formed in an upper end between the first subtank and the second subtank, near the filter in the first subtank.

According to this arrangement, when the treating liquid with a smaller specific gravity flows from the downstream second subtank to the upstream first subtank through the liquid channel formed in the upper end between the first subtank and the second subtank, the treating liquid is absorbed in the filter provided in the first subtank and mixes well together with the treating liquid with a greater specific gravity in the first subtank. Accordingly, the lighter treating liquid and the heavier treating liquid in a balanced state is supplied to the corresponding treating tank. In this case, providing the filter near the liquid channel contributes to well mixing of the lighter treating liquid with the heavier treating liquid.

An automatic developing system of developing a photographic sensitized material, according to another aspect of this invention, is provided with a first treating tank and a second treating tank each filled with the same kind of treating liquid therein and arranged sequentially from an upstream side to a downstream side in a feeding direction of the sensitized material, a first subtank and a second subtank each filled with the same kind of treating liquid as the first treating tank and the second treating tank therein and communicating with the first treating tank and the second treating tank, respectively side by side, a liquid channel formed between the first subtank and the second subtank to flow the treating liquid from the second subtank into the upstream first subtank therethrough by replenishing fresh treating liquid from an external source into the downstream second subtank. The system is characterized in that the liquid channel is formed in an upper end between the first subtank and the second subtank, and the first subtank is internally provided with a guide member for guiding the treating liquid flowing into the first subtank from the second subtank through the liquid channel downward.

According to this arrangement, the treating liquid with a smaller specific gravity which flows from the downstream second subtank to he upstream first subtank through the liquid channel formed in the upper end between the first subtank and the second subtank is guided downward along the guide member. Accordingly, the lighter treating liquid mixes well with the heavier treating liquid in the first subtank.

In the case where the treating liquid in the subtank is supplied to the corresponding treating tank through the filter, the lighter treating liquid flowing into the first subtank is supplied to the corresponding treating tank while being absorbed in the filter and mixing with the heavier treating liquid in the filter. Accordingly, the lighter treating liquid assuredly mixes well with the heavier treating liquid.

BEST MODE FOR CARRYING OUT THE INVENTION

Figure 1:
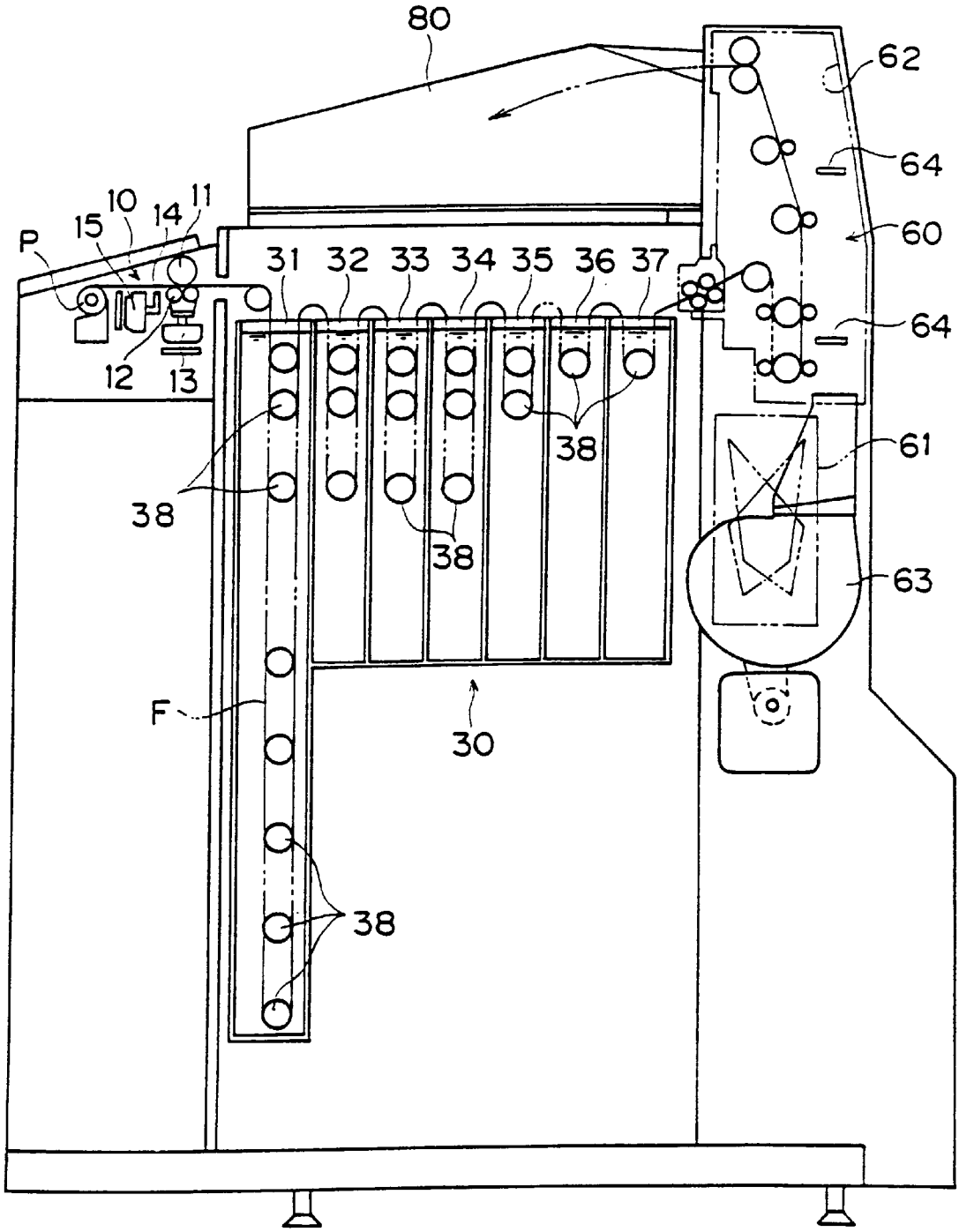
FIG. 1 is a diagram showing a schematic construction of an automatic developing system of developing a photographic sensitized material embodying the present invention.

FIG. 1 is a diagram showing a schematic construction of an automatic developing system of developing a photographic sensitized material embodying the present invention. In FIG. 1, the automatic developing system comprises a film loading unit 10 for loading a film F which is a roll of photographic sensitized material (simply referred to as a "sensitized material" hereinafter), a developing unit 30 for developing the film F drawn out from the film loading unit 10, a drying unit 60 for drying the film F after developed in the developing unit 30, and a film receiving unit 80 for temporarily storing the film F after dried in the drying unit 60. At least the film loading unit 10 and the developing unit 30 are constructed as a dark room shielded from external light.

The film loading unit 10 includes a transport roller 11 for feeding the film F downstream in a film feeding direction, a driven roller 12 movable up and down to press the film F against the transport roller 11, a solenoid 13 for activating the driven roller 12 in a vertical direction, a cutter 14 for cutting a tail end of the film F drawn out from a film cartridge P, and a solenoid 15 for activating the cutter 14 in the vertical direction.

The developing unit 30 includes a developing tank 31 filled with a developing liquid, a bleaching tank 32 filled with a bleaching liquid, a first fixing tank 33 and a second fixing tank 34 each filled with a fixing liquid, a first stabilizing tank 35, a second stabilizing tank 36, and a third stabilizing tank 37 each filled with a stabilizing liquid. These treating tanks (developing tank 31, bleaching tank 32, the first and second fixing tanks 33, 34, and the first to the third stabilizing tanks 35 to 37) are arranged in a line from upstream side (left side in FIG. 2) to downstream side (right side in FIG. 2) in the film feeding direction in this order via partition walls 311, 321, 331, 341, 351, and 361 each of which is formed between the adjacent treating tanks. A transport roller unit 38 is provided in each of the treating tanks 31, 32, 33, 34, 35, 36, and 37 to feed the film F drawn out from the film loading unit 10 from upstream to downstream while passing the film F in the developing liquid, the bleaching liquid, the fixing liquid, and the stabilizing liquid in this order.

Figure 2:
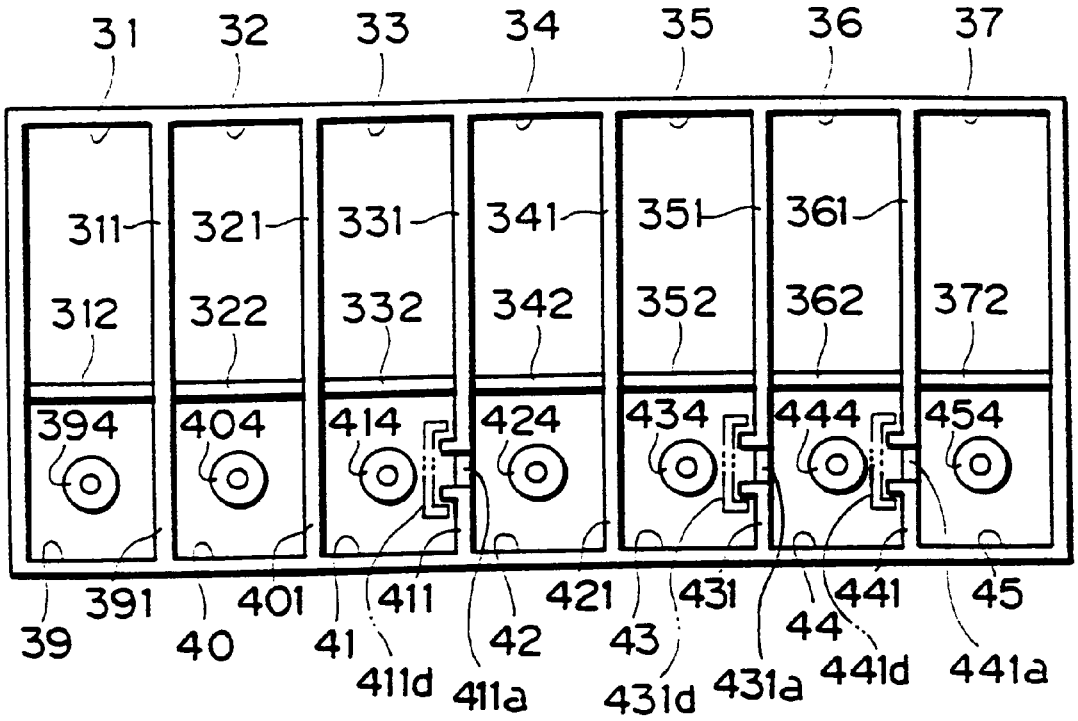
FIG. 2 is a plan view showing an essential part of the automatic developing system shown in FIG. 1.

Each of the treating tanks 31, 32, 33, 34, 35, 36, and 37 has an opening opened upward at a top surface thereof. As shown in FIG. 2, a developing subtank 39 filled with a developing liquid, a bleaching subtank 40 filled with a bleaching liquid, a first fixing subtank 41 and a second fixing subtank 42 each filled with a fixing liquid, a first stabilizing subtank 43, a second stabilizing subtank 44, and a third stabilizing subtank 45 each filled with a stabilizing liquid are arranged next to the corresponding treating tank via partition walls 312, 322, 332, 342, 352, 362, and 372, respectively.

Each of the subtanks 39, 40, 41, 42, 43, 44, and 45 has an opening opened upward at a top surface thereof, and these subtanks are arranged in a line via partition walls 391, 401, 411, 421, 431, and 441 each of which is formed between the adjacent subtanks. Similar to the treating tanks, these subtanks are arranged in a line from upstream to downstream in the film feeding direction. The treating tanks 31, 32, 33, 34, 35, 36, and 37 and the subtanks 39, 40, 41, 42, 43, 44, and 45 are respectively formed integral by e.g., casting a liquid synthetic resin into a mold and curing the resin therein.

Figure 3:
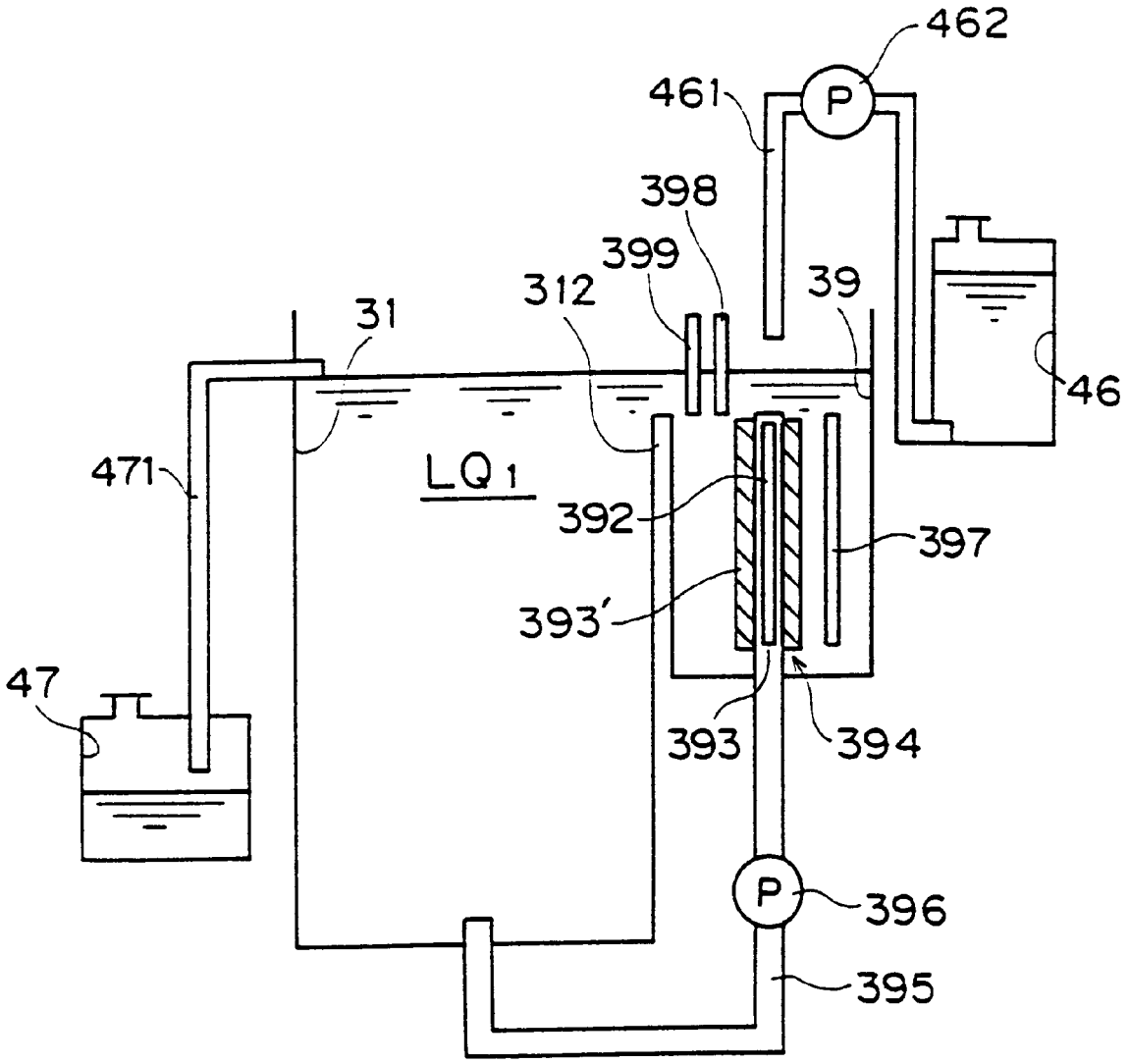
FIG. 3 is a diagram showing a construction of a developing tank and a developing subtank in a developing unit of the developing system in FIG. 2.

As mentioned above, the developing tank 31 and the developing subtank 39 are partitioned via the partition wall 312 but communicate with each other, as shown in FIG. 3, at an upper portion of the partition wall 312 to allow a developing liquid $LQ_1$ to freely flow over in the developing tank 31 and the subtank 39.

The developing subtank 39 is internally provided with a filter 394 extending in the vertical direction. The filter 394 is produced by winding a filtering material 393' around an outer circumference of a pipe 393 that is formed with a number of vertical slits 382 therein. The filter 394 is so constructed that the developing liquid $LQ_1$ flowing in a hollow space of the pipe 393 is supplied to a bottom portion of the developing tank 31 through a supply pipe 395 connected to a lower end of the filter 394 by activating a first developing liquid pump 396. Thereby, the developing liquid $LQ_1$ circulates in the developing tank 31 and the developing subtank 39.

The developing subtank 39 is internally provided with a heater 397 for heating the developing liquid $LQ_1$, a thermo sensor 398 (temperature adjuster) for maintaining the temperature of the developing liquid $LQ_1$ at a certain level (e.g., about 30° C.), and a liquid level sensor 399 (alert generator) for outputting an alert signal when the liquid level of the developing liquid $LQ_1$ exceeds a predetermined level. The developing subtank 39 is externally provided with a replenish tank 46 for supplying fresh developing liquid $LQ_1$ to the developing subtank 39 via a supply pipe 461 by activating a second developing liquid pump 462.

The developing tank 31 is externally provided with a drainage tank 47, and a drainage pipe 471 is mounted at an upper portion of the drainage tank 47. When the developing liquid $LQ_1$ is replenished in the developing subtank 39, and the developing tank 31 resultantly overflows, the overflowing, developing liquid $LQ_1$ is drained into the drainage tank 47 via the drainage pipe 471.

Figure 4:
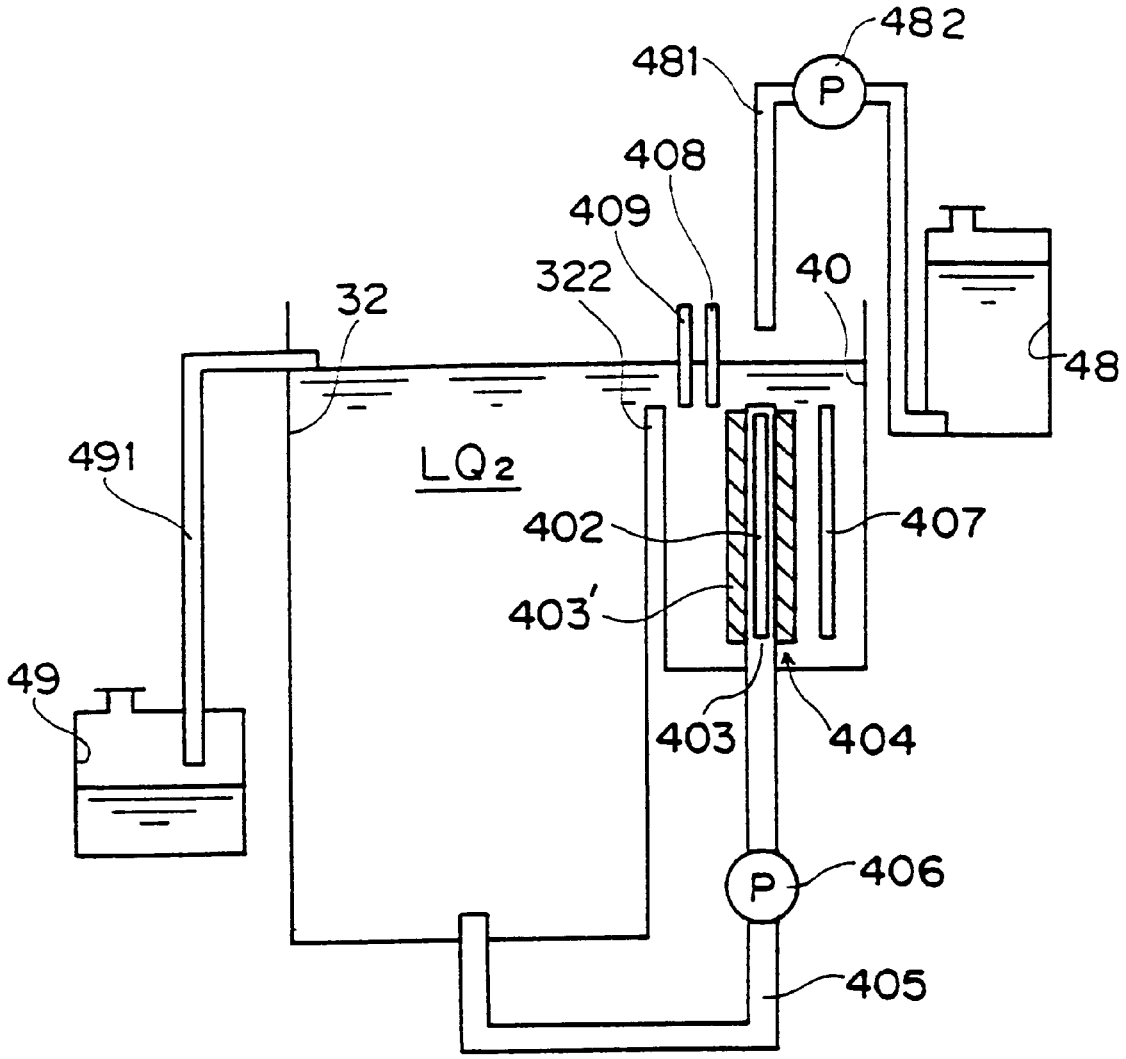
FIG. 4 is a diagram showing a construction of a bleaching tank and a bleaching subtank in the developing unit in FIG. 2.

As mentioned above, the bleaching tank 32 and the bleaching subtank 40 are partitioned via the partition wall 322 but communicate with each other, as shown in FIG. 4, at an upper portion of the partition wall 322 to allow a bleaching liquid $LQ_2$ to freely flow over in the bleaching tank 32 and the bleaching subtank 40.

The bleaching subtank 40 is internally provided with a filter 404. The filter 404 is produced by winding a filtering material 403' around an outer circumference of a pipe 403 that is formed with a number of vertical slits 402 therein. The filter 404 is so constructed that the bleaching liquid $LQ_2$ flowing in a hollow space of the pipe 403 is supplied to a bottom portion of the bleaching tank 32 through a supply pipe 405 connected to a lower end of the filter 404 by activating a first bleaching liquid pump 406. Thereby, the bleaching liquid $LQ_2$ circulates in the bleaching tank 32 and the bleaching subtank 40.

The bleaching subtank 40 is internally provided with a heater 407 for heating the bleaching liquid $LQ_2$, a thermo sensor 408 (temperature adjuster) for maintaining the temperature of the bleaching liquid $LQ_2$ at a certain level (e.g., about 30° C.), and a liquid level sensor 409 (alert generator) for outputting an alert signal when the liquid level of the bleaching liquid $LQ_2$ exceeds a predetermined level. The bleaching subtank 40 is externally provided with a replenish tank 48 for supplying fresh bleaching liquid $LQ_2$ to the bleaching subtank 40 via a supply pipe 481 by activating a second bleaching liquid pump 482.

The bleaching tank 32 is externally provided with a drainage tank 49, and a drainage pipe 491 is mounted at an upper portion of the drainage tank 49. When the bleaching liquid $LQ_2$ is replenished in the bleaching subtank 40, and the bleaching tank 32 resultantly overflows, the overflowing bleaching liquid $LQ_2$ is drained into the drainage tank 49 via the drainage pipe 491.

Figure 5:
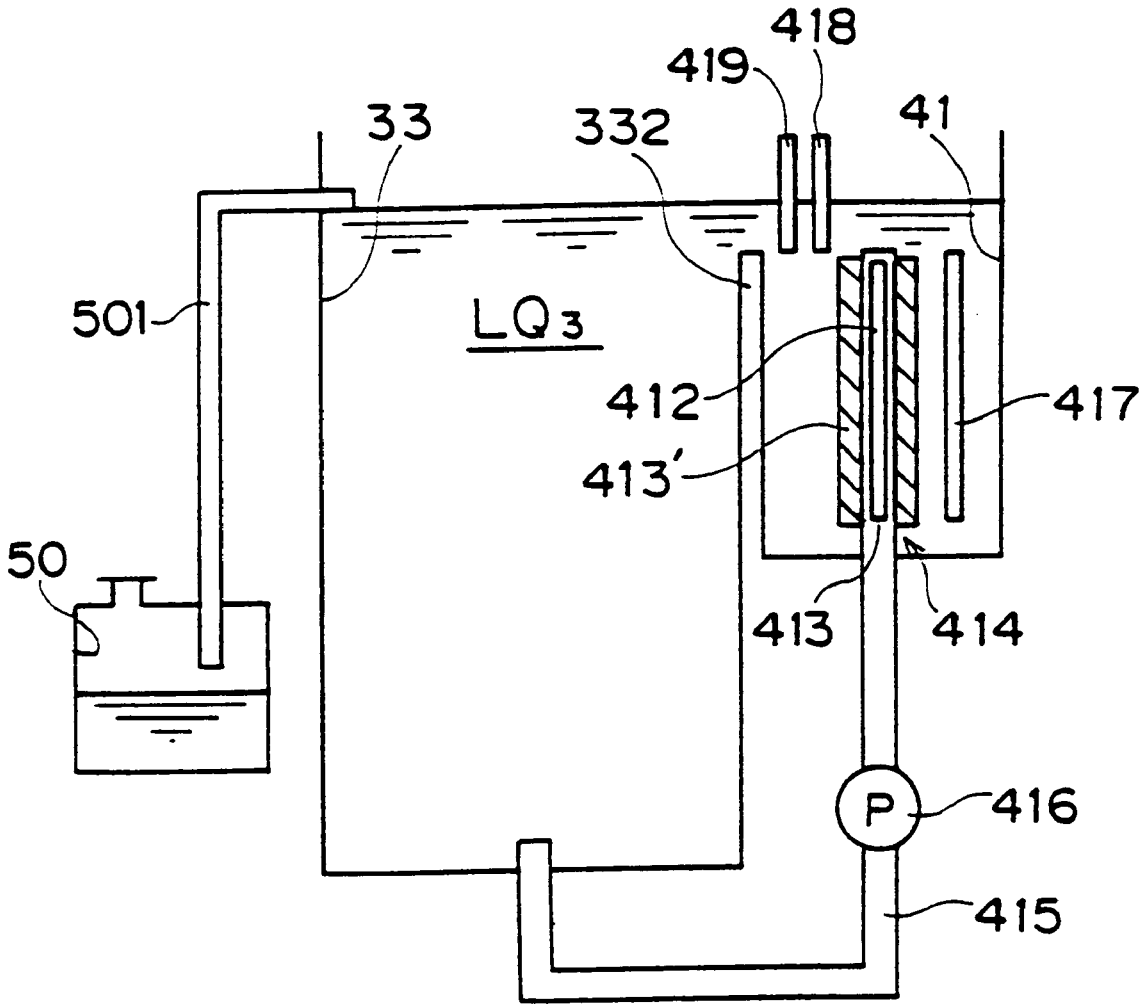
FIG. 5 is a diagram showing a construction of a first fixing tank and a first fixing subtank in the developing unit in FIG. 2.

As mentioned above, the first fixing tank 33 and the first fixing subtank 41 are partitioned via the partition wall 332 but communicate with each other, as shown in FIG. 5, at an upper portion of the partition wall 332 to allow a fixing liquid $LQ_3$ to freely flow over in the first axing tank 33 and the first fixing subtank 41.

The first fixing subtank 41 is internally provided with a filter 414. The filter 414 is produced by winding a filtering material 413' around an outer circumference of a pipe 413 that is formed with a number of vertical slits 412 therein. The filter 414 is so constructed that the fixing liquid $LQ_3$ flowing in a hollow space of the pipe 413 is supplied to a bottom portion of the first fixing tank 33 through a supply pipe 415 connected to a lower end of the filter 414 by activating a first fixing liquid pump 416. Thereby, the fixing liquid $LQ_3$ circulates in the first fixing tank 33 and the first fixing subtank 41.

The first fixing subtank 41 is internally provided with a heater 417 for heating the fixing liquid $LQ_3$, a thermo sensor 418 (temperature adjuster) for maintaining the temperature of the fixing liquid $LQ_3$ at a certain level (e.g., about 30° C.), and a liquid level sensor 419 (alert generator) for outputting an alert signal when the liquid level of the fixing liquid $LQ_3$ exceeds a predetermined level. The first fixing tank 33 is externally provided with a drainage tank 50, and a drainage pipe 501 is mounted at an upper portion of the drainage tank 50. As described later, when the second fixing subtank 42 is replenished with fresh fixing liquid $LQ_3$, and the first fixing tank 33 resultantly overflows, the overflowing fixing liquid $LQ_3$ is drained into the drainage tank 50 through the drainage pipe 501.

Figure 6:
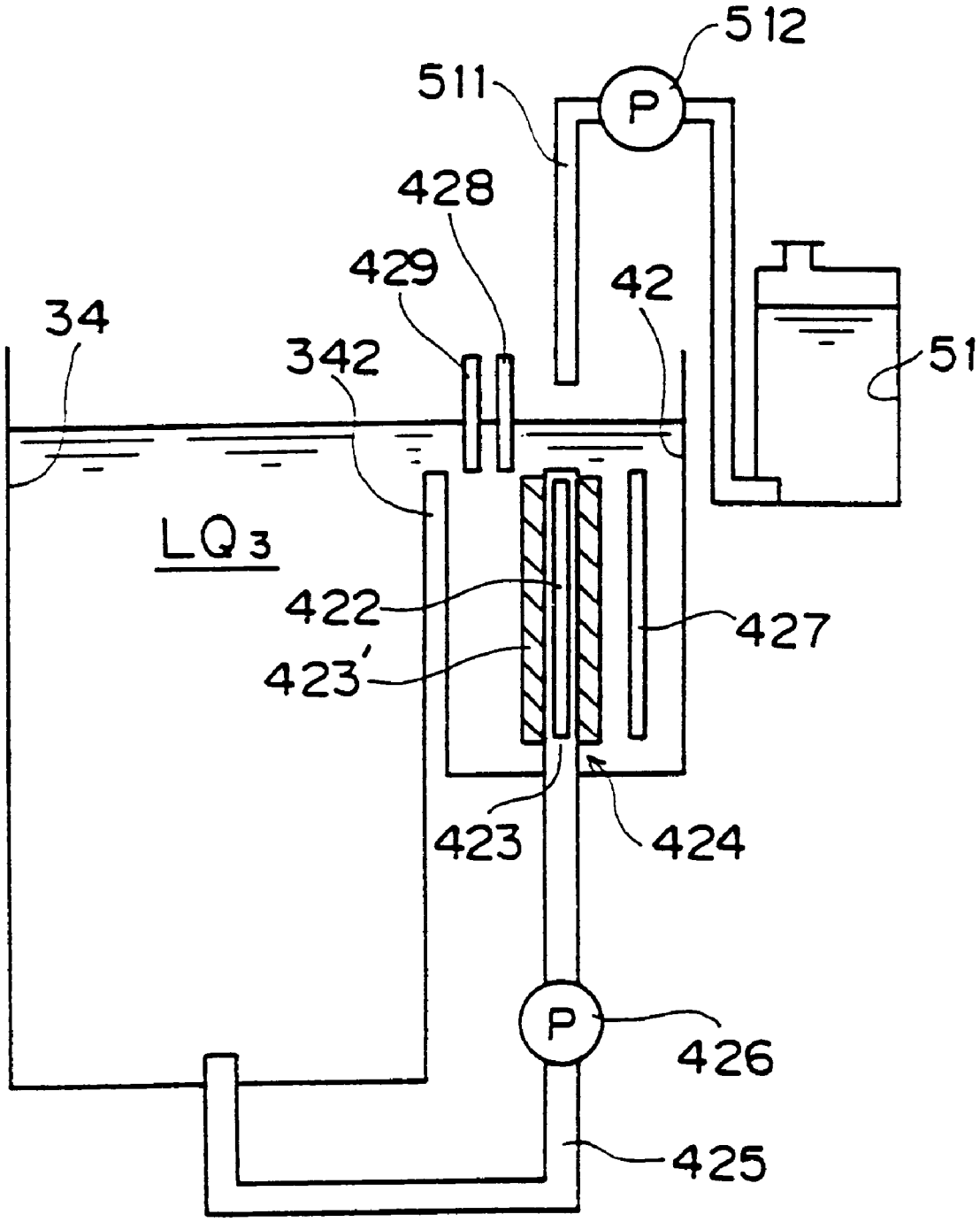
FIG. 6 is a diagram showing a construction of a second fixing tank and a second fixing subtank in the developing unit in FIG. 2.

As mentioned above, the second fixing tank 34 and the second fixing subtank 42 are partitioned by the partition wall 342 but communicate with each other, as shown in FIG. 6, at an upper portion of the partition wall 342 to allow the fixing liquid $LQ_3$ to freely flow over in the second fixing tank 34 and the second fixing subtank 42.

The second fixing subtank 42 is internally provided with a filter 424. The filter 424 is produced by winding a filtering material 423' around an outer circumference of a pipe 423 that is formed with a number of vertical slits 422 therein. The filter 424 is so constructed that the fixing liquid $LQ_3$ flowing in a hollow space of the pipe 423 is supplied to a bottom portion of the second fixing tank 34 through a supply pipe 425 connected to a lower end of the filter 424 by activating a second fixing liquid pump 426. Thereby, the fixing liquid $LQ_3$ circulates in the second fixing tank 34 and the second fixing subtank 42.

The second fixing subtank 42 is internally provided with a heater 427 for heating the fixing liquid $LQ_2$, a thermo sensor 428 (temperature adjuster) for maintaining the temperature of the fixing liquid $LQ_3$ at a certain level (e.g., about 30° C.), and a liquid level sensor 429 (alert generator) for outputting an alert signal when the liquid level of the fixing liquid $LQ_3$ exceeds a predetermined level. The second fixing subtank 42 is externally provided with a replenish tank 51 for replenishing fresh fixing liquid $LQ_3$ to the second fixing subtank 42 via a supply pipe 511 by activating a third fixing liquid pump 512.

Figure 7:
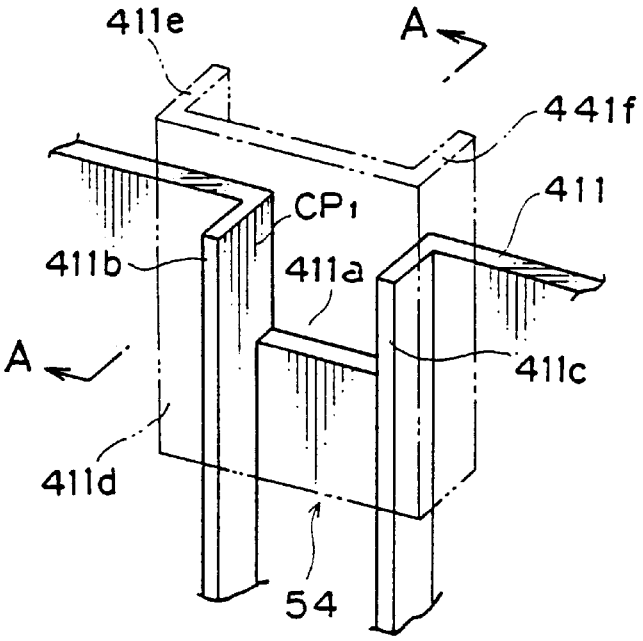
FIG. 7 is a diagram showing a construction of a liquid channel between the first fixing subtank and the second fixing subtank and a guide member in the first fixing subtank.
Figure 8:
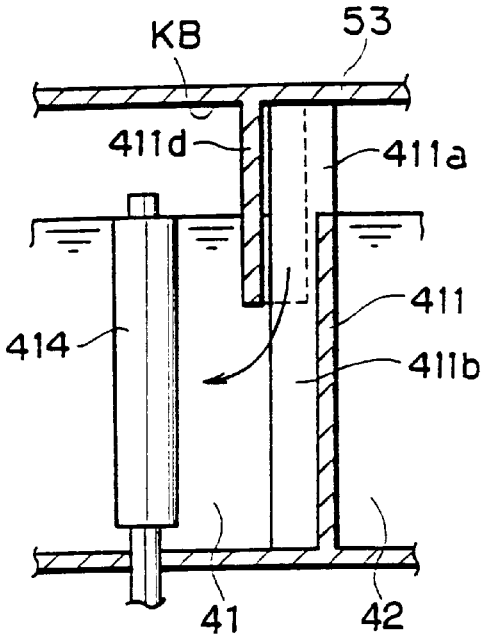
FIG. 8 is a cross sectional view taken along the line A—A in FIG. 7 showing the construction of the first fixing subtank and the second fixing subtank and the guide member.

As shown in FIGS. 7 and 8, a cutaway $CP_1$ is formed in an upper end of the partition wall 411 partitioning the first fixing subtank 41 and the second fixing subtank 42 to form a liquid channel 411*a*. A pair of projecting plates 411*b*, 411*c* (constituting a first bank) are formed in an upright state along lateral opposite ends of the liquid channel 411*a* projecting toward the first fixing subtank 41 and extending from an upper end to a lower end of the partition wall 411. An opposing plate 411*d* is provided at an upper portion of the projecting plate pair 411*b*, 411*c*, namely, at a position opposing to the liquid channel 411*a* and the partition wall 411 at a lower position of the liquid channel 411*a* in such a manner as to encompass the projecting plates 411*b*, 411*c*.

A pair of side plates 411*e*, 411*f* (constituting a second bank) in an upright state are formed at lateral opposite ends of the opposing plate 411*d* projecting toward the partition wall 411. The side plates 411*e*, 411*f* respectively oppose to the projecting plates 411*b*, 411*c* at respective outer ends. Specifically, the side plates 411*e*, 411*f* of the opposing plate 411*d* are so formed as to encompass the projecting plates 411*b*, 411*c*.

As a result, when the fresh fixing liquid $LQ_3$ is supplied to the second fixing subtank 42, the liquid level of the second fixing tank 34 and the second fixing subtank 42 are raised. Accordingly, the fixing liquid $LQ_3$ flows into the upstream located first fixing subtank 41 from the downstream located second fixing subtank 42 through the liquid channel 411*a*, with the result that the flow-in fixing liquid $LQ_3$ is guided downward in the first fixing subtank 41 along a passage defined by the pair of projecting plates 411*b*, 411*c* and the opposing plate 411*d*.

The thus guided fixing liquid $LQ_3$ is mixed with the fixing liquid $LQ_3$ in the subtank 41, and the mixed fixing liquid $LQ_3$ is supplied to the first fixing tank 33 through the filter 414 with the result that the liquid level of the first fixing tank 33 is raised. Then, the overflowing fixing liquid $LQ_3$ in the first fixing tank 33 is drained in the drainage tank 50 through the drainage pipe 501.

In other words, the projecting plate pair 411*b*, 411*c* and the opposing plate 411*d* constitute a guide member 54 for guiding the fixing liquid $LQ_3$ flowing from the second fixing subtank 42 downward in the first fixing subtank 41. It should be noted that the projecting plate pair 411*b*, 411*c* may be formed at least at a lower position on lateral opposite ends of the liquid channel 411*a*.

In this embodiment, as shown in FIG. 8, the opposing plate 411*d* is formed integral with a lower surface of a cover 53 which covers an opening KB of each of the subtanks 39, 40, 41, 42, 43, 44, and 45. The opposing plate 411*d* is so formed as to oppose to the liquid channel 411*a* and the partition wall 411 at the lower position of the liquid channel 411*a* when the cover 53 covers the opening KB of each of the subtanks 39, 40, 41, 42, 43, 44, and 45.

In this arrangement, the position of the opposing plate 411*d* can be set easily. Further, the side plates 411*e*, 411*f* of the opposing plate 411*d* are so formed as to encompass the projecting plates 411*b*, 411*c*. Accordingly, a passage is defined between the side plates 411*e*, 411*f* and the projecting plates 411*b*, 411*c*. Thereby, the fixing liquid $LQ_3$ flowing in the first fixing subtank 41 can be securely guided downward therein along the passage.

Figure 9:
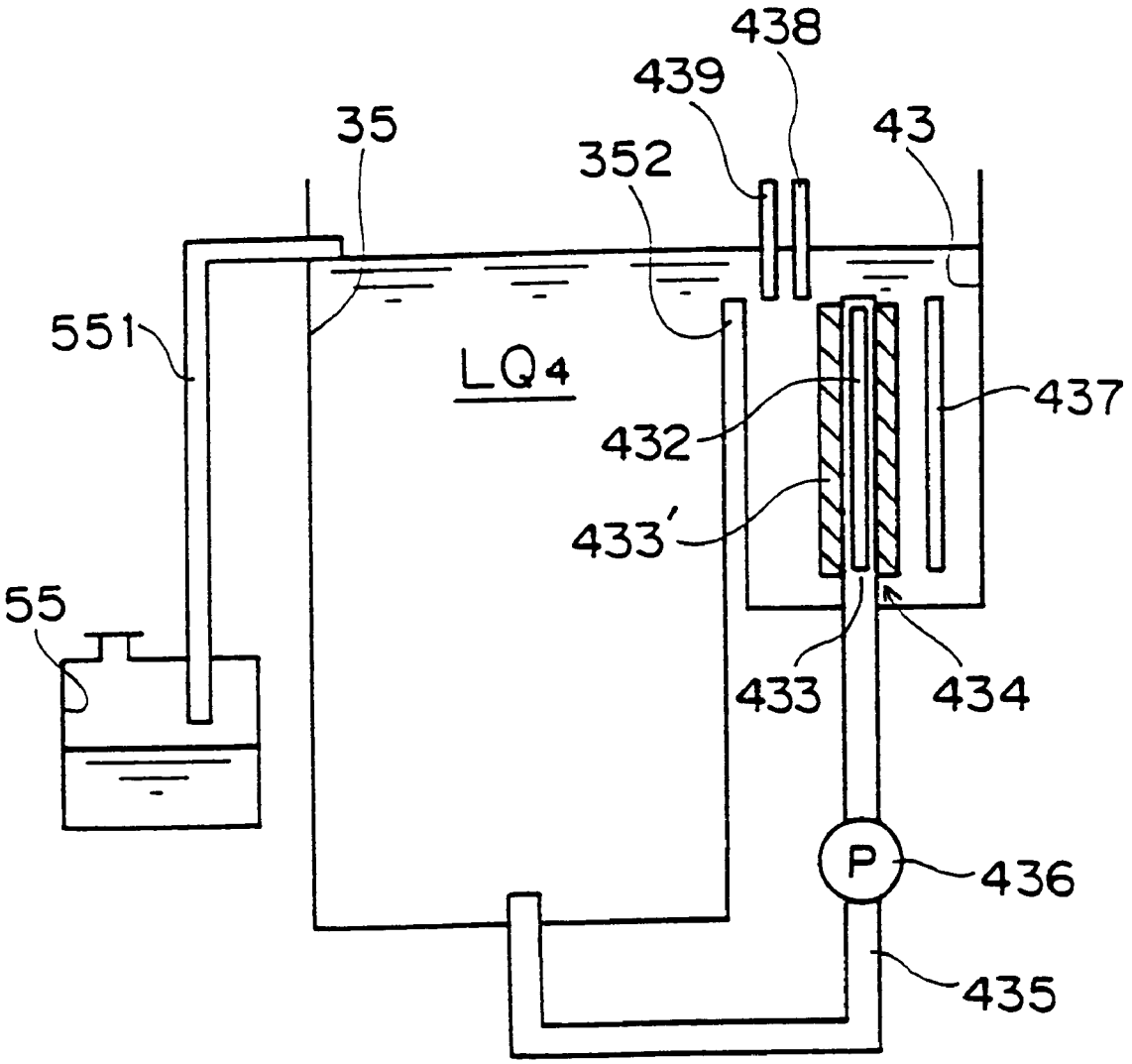
FIG. 9 is a diagram showing a construction of a first stabilizing tank and a first stabilizing subtank in the developing unit in FIG. 2.

As mentioned above, the first stabilizing tank 35 and the first stabilizing subtank 43 are partitioned by the partition wall 352 but communicate with each other at an upper portion of the partition wall 352, as shown in FIG. 9, to allow a stabilizing liquid $LQ_4$ to freely flow over in the first stabilizing tank 35 and the first stabilizing subtank 43.

The first stabilizing subtank 43 is internally provided with a filter 434. The filter 434 is produced by winding a filtering material 433' around an outer circumference of a pipe 433 that is formed with a number of vertical slits 432 therein. The filter 434 is so constructed that the stabilizing liquid $LQ_4$ flowing in a hollow space of the pipe 433 is supplied to a bottom portion of the first stabilizing tank 35 through a supply pipe 435 connected to a lower end of the filter 434 by activating a first stabilizing liquid pump 436. Thereby, the stabilizing liquid $LQ_4$ circulates in the first stabilizing tank 35 and the first stabilizing subtank 43.

The first stabilizing subtank 43 is internally provided with a heater 437 for heating the stabilizing liquid $LQ_4$, a thermo sensor 438 (temperature adjuster) for maintaining the temperature of the stabilizing liquid $LQ_4$ at a certain level (e.g., about 30° C.), and a liquid level sensor 439 (alert generator) for outputting an alert signal when the liquid level of the stabilizing liquid $LQ_4$ exceeds a predetermined level.

The first stabilizing tank 35 is externally provided with a drainage tank 55, and a drainage pipe 551 is mounted at an upper portion of the drainage tank 55. As described later, when the third stabilizing subtank 45 is replenished with fresh stabilizing liquid $LQ_4$, and the first stabilizing tank 35 resultantly overflows, the overflowing stabilizing liquid $LQ_4$ is drained into the drainage tank 55 through the drainage pipe 551.

Figure 10:
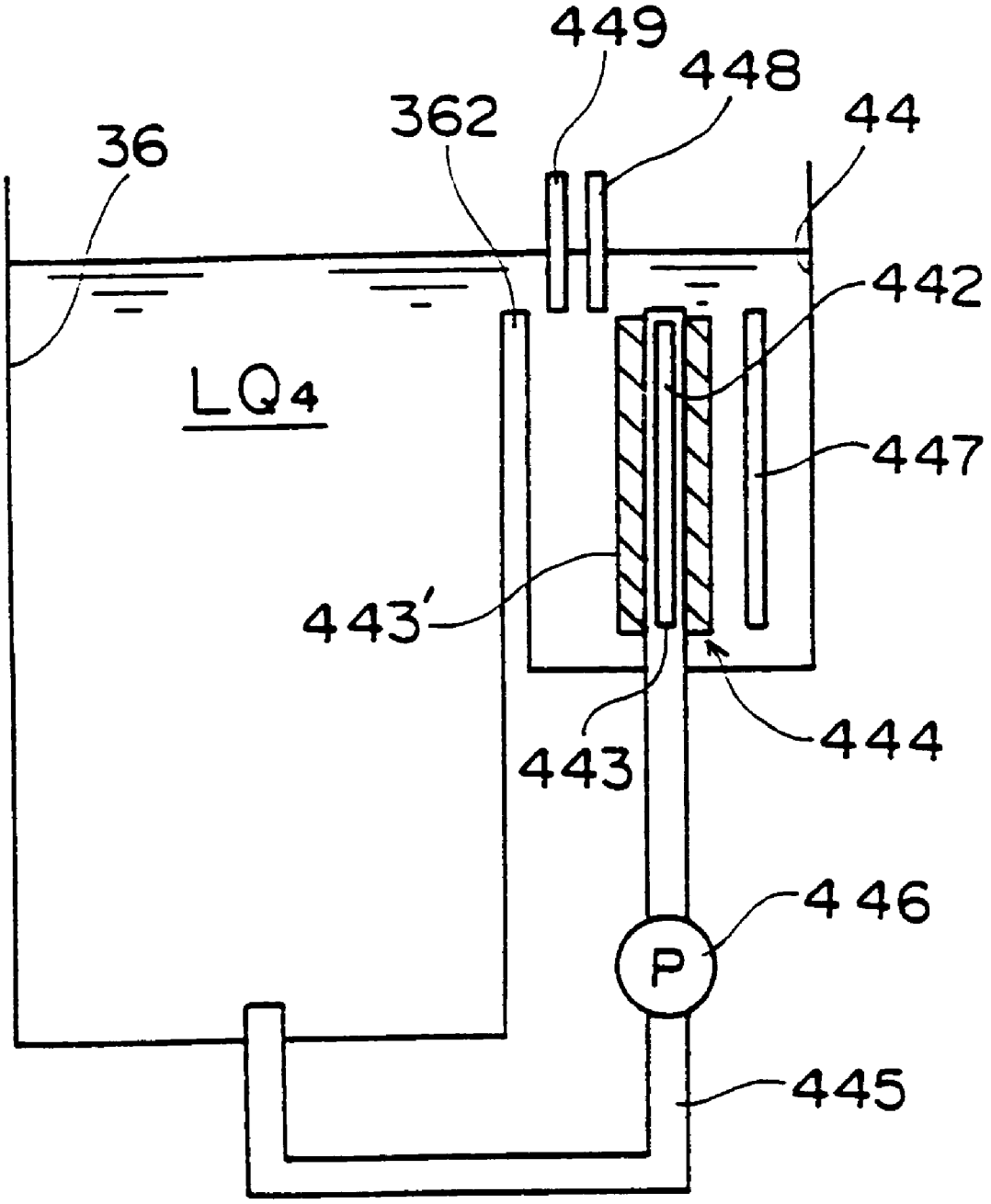
FIG. 10 is a diagram showing a construction of a second stabilizing tank and a second stabilizing subtank in the developing unit in FIG. 2.

As described above, the second stabilizing tank 36 and the second stabilizing subtank 44 are partitioned by the partition wall 362 but communicate with each other at an upper portion of the partition wall 362, as shown in FIG. 10, to allow the stabilizing liquid $LQ_4$ to freely flow over in the second stabilizing tank 36 and the second stabilizing subtank 44.

The second stabilizing subtank 44 is internally provided with a filter 444. The filter 444 is produced by winding a filtering material 443' around an outer circumference of a pipe 443 that is formed with a number of vertical slits 442 therein. The filter 444 is so constructed that the stabilizing liquid $LQ_4$ flowing in a hollow space of the pipe 443 is supplied to a bottom portion of the second stabilizing tank 36 through a supply pipe 445 connected to a lower end of the filter 444 by activating a second stabilizing liquid pump 446. Thereby, the stabilizing liquid $LQ_4$ circulates in the second stabilizing tank 36 and the second stabilizing subtank 44.

The second stabilizing subtank 44 is internally provided with a heater 447 for heating the stabilizing liquid $LQ_4$, a thermo sensor 448 (temperature adjuster) for maintaining the temperature of the stabilizing liquid $LQ_4$ at a certain level (e.g., about 30° C.), and a liquid level sensor 449 (alert generator) for outputting an alert signal when the liquid level of the stabilizing liquid $LQ_4$ exceeds a predetermined level.

Figure 11:
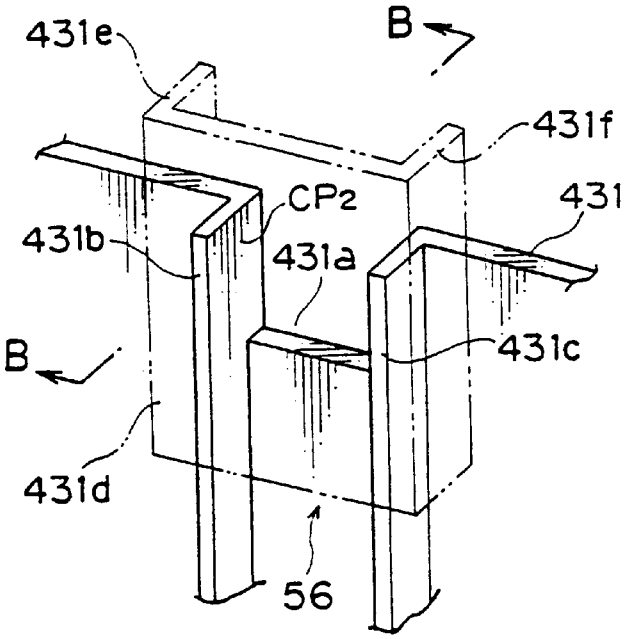
FIG. 11 is a diagram showing a construction of a liquid channel between the first stabilizing subtank and the second stabilizing subtank and a guide member in the first stabilizing subtank.
Figure 12:
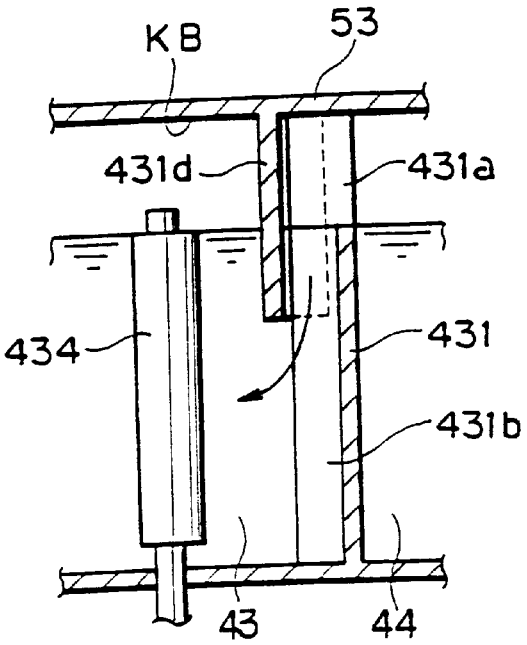
FIG. 12 is a cross sectional view taken along the line B—B in FIG. 11 showing the construction of the first stabilizing subtank and the second stabilizing subtank and the guide member.

As shown in FIGS. 11 and 12, a cutaway $CP_2$ is formed in an upper end of the partition wall 431 partitioning the first stabilizing subtank 43 and the second stabilizing subtank 44 to form a liquid channel 431*a*. A pair of projecting plates 431*b*, 431*c* (constituting a first bank) are formed in an upright state along lateral opposite ends of the liquid channel 431*a* projecting toward the first stabilizing subtank 43 and extending from an upper end to a lower end of the partition wall 431. An opposing plate 431*d* is provided at an upper portion of the projecting plate pair 431*b*, 431*c*, namely at a position opposing to the liquid channel 431*a* and the partition wall 431 at a lower position of the liquid channel 431*a* in such a manner as to encompass the projecting plates 431*b*, 431*c*.

A pair of side plates 431*e*, 431*f* (constituting a second bank) in an upright state are formed at lateral opposite ends of the opposing plate 431*d* projecting toward the partition wall 431. The side plates 431*e*, 431*f* respectively oppose to the projecting plates 431*b*, 431*c* at respective outer ends. Specifically, the side plates 431*e*, 431*f* of the opposing plate 431*d* are so formed as to encompass the projecting plates 431*b*, 431*c*.

As a result, when the fresh stabilizing liquid $LQ_4$ is supplied from the downstream located third stabilizing subtank 45 into the second stabilizing subtank 44, as described later, the liquid level of the second stabilizing tank 36 and the second stabilizing subtank 44 are raised. Accordingly, the stabilizing liquid $LQ_4$ flows into the upstream located first stabilizing subtank 43 from the downstream located second stabilizing subtank 44 through the liquid channel 431*a*, with the result that the flow-in stabilizing liquid $LQ_4$ is guided downward in the first stabilizing subtank 43 along a passage defined by the pair of projecting plates 431*b*, 431*c* and the opposing plate 431*d*. The thus guided stabilizing liquid $LQ_4$ is mixed with the stabilizing liquid $LQ_4$ in the subtank 43, and the mixed stabilizing liquid $LQ_4$ is supplied to the first stabilizing tank 35 through the filter 444 with the result that the liquid level of the first stabilizing tank 35 is raised. Then, the overflowing stabilizing liquid $LQ_4$ in the first stabilizing tank 35 is drained in the drainage tank 55 through the drainage pipe 551.

In other words, the projecting plate pair 431*b*, 431*c* and the opposing plate 431*d* constitute a guide member 56 for guiding the stabilizing liquid $LQ_4$ flowing from the second stabilizing subtank 44 downward into the first stabilizing subtank 43. It should be noted that the projecting plate pair 431*b*, 431*c* may be formed at least at a lower position on lateral opposite ends of the liquid channel 431*a*.

In this embodiment, as shown in FIG. 12, the opposing plate 431*d* is formed integral with a lower surface of the cover 53 which covers the opening KB of each of the subtanks 39, 40, 41, 42, 43, 44, and 45. The opposing plate 431*d* is so formed as to oppose to the liquid channel 431*a* and the partition wall 431 at the lower position of the liquid channel 431*a* when the cover 53 covers the opening KB of each of the subtanks 39, 40, 41, 42, 43, 44, and 45. Thereby, the position of the opposing plate 411*d* can be set easily. Further, the side plates 431*e*, 431*f* of the opposing plate 431*d* are so formed as to encompass the projecting plates 431*b*, 431*c*. Accordingly, a passage is defined between the side plates 431*e*, 431*f* and the projecting plates 431*b*, 431*c*. Thereby, the stabilizing liquid $LQ_4$ flowing in the first stabilizing subtank 43 can be securely guided downward therein along the passage.

Figure 13:
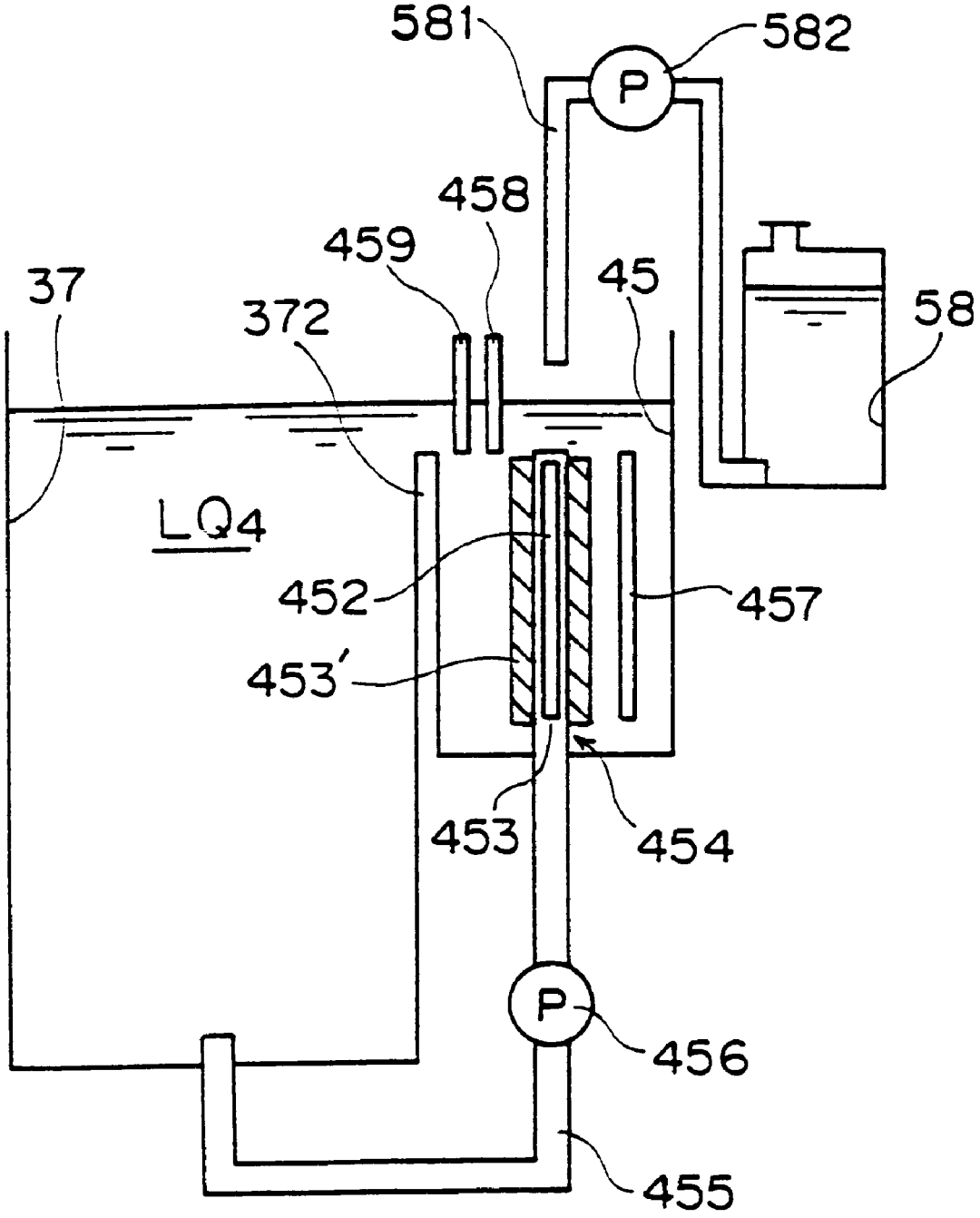
FIG. 13 is a diagram showing a third stabilizing tank and a third stabilizing subtank in the developing unit in FIG. 2.

As mentioned above, the third stabilizing tank 37 and the third stabilizing subtank 45 are partitioned by the partition wall 372 but communicate with each other at an upper portion of the partition wall 372, as shown in FIG. 13, to allow the stabilizing liquid $LQ_4$ to freely flow over in the third stabilizing tank 37 and the third stabilizing subtank 45.

The third stabilizing subtank 45 is internally provided with a filter 454. The filter 454 is produced by winding a filtering material 453' around an outer circumference of a pipe 453 that is formed with a number of vertical slits 452 therein. The filter 454 is so constructed that the stabilizing liquid $LQ_4$ flowing in a hollow space of the pipe 453 is supplied to a bottom portion of the third stabilizing tank 37 through a supply pipe 455 connected to a lower end of the filter 454 by activating a fourth stabilizing liquid pump 456. Thereby, the stabilizing liquid $LQ_4$ circulates in the third stabilizing tank 37 and the third stabilizing subtank 45.

The third stabilizing subtank 45 is internally provided with a heater 457 for heating the stabilizing liquid $LQ_4$, a thermo sensor 458 (temperature adjuster) for maintaining the temperature of the stabilizing liquid $LQ_4$ at a certain level (e.g., about 30° C.), and a liquid level sensor 459 (alert generator) for outputting an alert signal when the liquid level of the stabilizing liquid $LQ_4$ exceeds a predetermined level. The third stabilizing subtank 45 is externally provided with a replenish tank 58 for replenishing fresh stabilizing liquid $LQ_4$ in the third stabilizing subtank 45 through a supply pipe 581 by activating a fourth stabilizing liquid pump 582.

Figure 14:
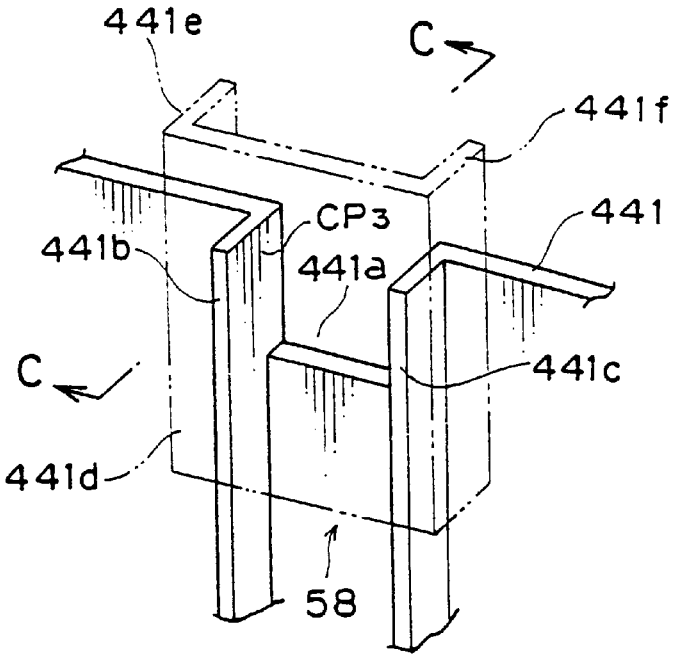
FIG. 14 is a diagram showing a construction of a liquid channel between the second stabilizing subtank and the third stabilizing subtank and a guide member in the second stabilizing subtank.
Figure 15:
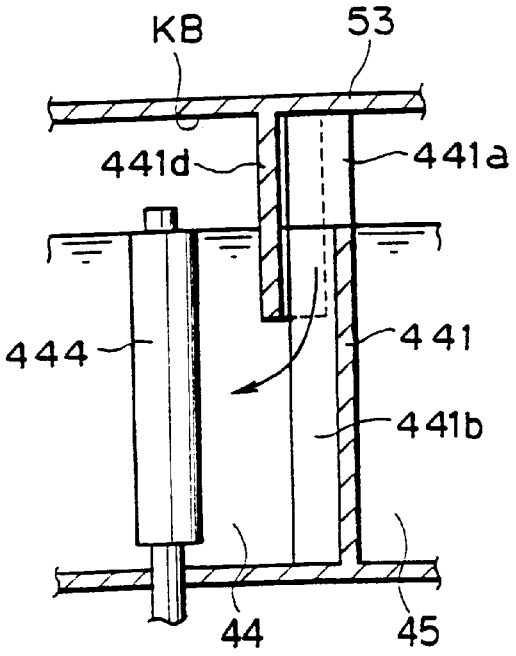
FIG. 15 is a cross sectional view taken along the line C—C in FIG. 14 showing the construction of the liquid channel between the second stabilizing subtank and the third stabilizing subtank and the guide member.

As shown in FIGS. 14 and 15, a cutaway $CP_3$ is formed in an upper end of the partition wall 441 partitioning the second stabilizing subtank 44 and the third stabilizing subtank 45 to form a liquid channel 441*a*. A pair of projecting plates 441*b*, 441*c* (constituting a first bank) are formed in an upright state along lateral opposite ends of the liquid channel 441*a* projecting toward the second stabilizing subtank 44 and extending from an upper end to a lower end of the partition wall 441.

An opposing plate 441*d* is provided at an upper portion of the projecting plate pair 441*b*, 441*c*, namely, at a position opposing to the liquid channel 441*a* and the partition wall 441 at a lower position of the liquid channel 441*a* in such a manner as to encompass the projecting plates 441*b*, 441*c*. A pair of side plates 441*e*, 441*f* (constituting a second bank) in an upright state are formed at lateral opposite ends of the opposing plate 441*d* projecting toward the partition wall 441. The side plates 441*e*, 441*f* respectively oppose to the projecting plates 441*b*, 441*c* at respective outer ends. Specifically, the side plates 441*e*, 441*f* of the opposing plate 441*d* are so formed as to encompass the projecting plates 441*b*, 441*c*.

As a result, when the fresh stabilizing liquid $LQ_4$ is supplied to the third stabilizing subtank 45, the liquid level of the third stabilizing tank 37 and the third second stabilizing subtank 45 are raised. Accordingly, the stabilizing liquid $LQ_4$ flows into the upstream located second stabilizing subtank 44 from the downstream located third stabilizing subtank 45 through the liquid channel 441*a*, with the result that the flow-in stabilizing liquid $LQ_4$ is guided downward in the second stabilizing subtank 44 along a passage defined by the pair of projecting plates 441*b*, 441*c* and the opposing plate 441*d*. The thus guided stabilizing liquid $LQ_4$ is mixed with the stabilizing liquid $LQ_4$ in the subtank 44, and the mixed stabilizing liquid $LQ_4$ is supplied to the second stabilizing tank 36 through the filter 444. In other words, the projecting plate pair 441*b*, 441*c* and the opposing plate 441*d* constitute a guide member 58 for guiding the stabilizing liquid $LQ_4$ flowing from the third stabilizing subtank 45 downward into the second stabilizing subtank 44. It should be noted that the projecting plate pair 441*b*, 441*c* may be formed at least at a lower position on lateral opposite ends of the liquid channel 441*a*.

In this embodiment, as shown in FIG. 15, the opposing plate 441*d* is formed integral with a lower surface of the cover 53 which covers the opening KB of each of the subtanks 39, 40, 41, 42, 43, 44, and 45. The opposing plate 441*d* is so formed as to oppose to the liquid channel 441*a* and the partition wall 441 at the lower position of the liquid channel 441*a* when the cover 53 covers the opening KB of each of the subtanks 39, 40, 41, 42, 43, 44, and 45. Thereby, the position of the opposing plate 441*d* can be set easily. Further, the side plates 441*e*, 441*f* of the opposing plate 441*d* are so formed as to encompass the projecting plates 441*b*, 441*c*. Accordingly, a passage is defined between the side plates 441*e*, 441*f* and the projecting plates 441*b*, 441*c*. Thereby, the stabilizing liquid $LQ_4$ flowing in the second stabilizing subtank 44 can be securely guided downward therein along the passage.

The drying unit 60 includes a heater 61, a dryer room 62 for enclosing a transport path along which the film F is fed from the developing unit 30 to the film receiving unit 80, a fan 63 for blowing heated air around the heater 61 into the dryer room 62, and a thermo sensor 64 for detecting the temperature in the dryer room 62. The film receiving unit 80 is provided with a spool (not shown) for taking up the film F after the drying operation according to needs.

Next, an operation of the automatic developing system having the above construction is described. An overall operation of this automatic developing system is controlled by an unillustrated control system including a CPU and a memory.

First, an operation of the system as a whole is briefly described. When a power switch is turned on, electricity is applied to heaters 397, 407, 417, 427, 437, 447, and 457 in the subtanks 39, 40, 41, 42, 43, 44, and 45 of the developing unit 30 to heat the treating liquid in each of the subtanks 39, 40, 41, 42, 43, 44, and 45 to a predetermined temperature. At this time, the liquid level of the treating liquid is set at a predetermined level. Also, electricity is applied to a heater 60 of the drying unit 60 to heat the temperature inside the dryer room 62 at a predetermined level by activating the fan 63.

At this state, when the film F to be developed is loaded in the film loading unit 10, the lead end of the film F is engaged with the transport roller unit 38, and a start button is turned on, the film F is immersed in the developing liquid $LQ_1$ in the developing tank 31, the bleaching liquid $LQ_2$ in the bleaching tank 32, the fixing liquid $LQ_3$ in the first and second fixing tanks 33, 34, and the stabilizing liquid $LQ_4$ in the first, second, third stabilizing tanks 35, 36, 37 in this order for a developing operation. The film F after the developing is fed to the drying unit 60 for drying operation and discharged onto the film receiving unit 80. When the entirety of the film F is drawn out from the film cartridge P, the tail end of the film F is cut by the cutter 14.

Next, a developing operation of the developing unit 30 is described. When the start button is turned on, as mentioned above, the first developing liquid pump 396, the second developing liquid pump 462, the first bleaching pump 406, the second bleaching pump 482, the first fixing liquid pump 416, the second fixing liquid pump 426, the third fixing liquid pump 512, the first stabilizing pump 436, the second stabilizing pump 446, the third stabilizing liquid pump 456, and the fourth stabilizing liquid pump 582 are activated.

When the first developing liquid pump 396 and the second developing liquid pump 462 are activated, the developing liquid $LQ_1$ in the developing subtank 39 is supplied to the developing tank 31 while having particles and other foreign matters removed through the filter 394. Thereby, the developing liquid $LQ_1$ circulates in the developing subtank 39 and the developing tank 31. On the other hand, fresh developing liquid $LQ_1$ is continuously (or intermittently) replenished from the replenish tank 46 to the developing subtank 39. Thereby, the liquid level of the developing subtank 39 is raised, and the overflowing developing liquid $LQ_1$ in the developing tank 31 is drained into the drainage tank 47 through the drainage pipe 471. Thus, the developing liquid $LQ_1$ in the developing tank 31 is constantly set at a predetermined condition for developing.

When the first bleaching liquid pump 406 and the second bleaching liquid pump 482 are activated, the bleaching liquid $LQ_2$ in the bleaching subtank 40 is supplied to the bleaching tank 32 while having particles and other foreign matters removed through the filter 404. Thereby, the bleaching liquid $LQ_2$ circulates in the bleaching subtank 40 and the bleaching tank 32. On the other hand, fresh developing liquid $LQ_2$ is continuously (or intermittently) replenished from the replenish tank 48 to the bleaching subtank 40. Thereby, the liquid level of the bleaching subtank 40 is raised, and the overflowing bleaching liquid $LQ_2$ in the bleaching tank 32 is drained into the drainage tank 49 through the drainage pipe 491. Thus, the bleaching liquid $LQ_2$ in the bleaching tank 32 is constantly set at a predetermined condition for bleaching.

When the first fixing liquid pump 416, the second fixing liquid pump 426, and the third fixing liquid pump 512 are activated, the fixing liquid $LQ_3$ in the first fixing subtank 41 and the second fixing subtank 42 are respectively supplied to the first fixing tank 33 and the second fixing tank 34 while having particles and other foreign matters removed through the filter 414 and the filter 424 respectively. Thereby, the fixing liquid $LQ_3$ circulates in the first fixing subtank 41 and the first fixing tank 33, and in the second fixing subtank 42 and the second fixing tank 34, respectively.

On the other hand, fresh fixing liquid $LQ_3$ is continuously (or intermittently) replenished from the replenish tank 51 to the second fixing subtank 42. Thereby, the liquid level of the second fixing tank 34 and the second fixing subtank 42 is raised, and the fixing liquid $LQ_3$ overflows from the downstream located second fixing subtank 42 into the upstream located first fixing subtank 41 through the liquid channel 411*a* formed in the partition wall 411. The fixing liquid $LQ_3$ is guided downward in the first fixing subtank 41 by the guide member 54 with the result that the downward guided liquid $LQ_3$ mixes with the fixing liquid $LQ_3$ in the first fixing subtank 41. Further, the fixing liquid $LQ_3$ guided downward in the first fixing subtank 41 by the guide member 54 is supplied to the first fixing tank 33 through the filter 414. Accordingly, the fixing liquid $LQ_3$ assuredly mixes with the fixing liquid $LQ_3$ in the first fixing tank 33.

In the case of supplying fresh fixing liquid $LQ_3$ from the replenish tank 51 to the second fixing subtank 42, it may be preferable to supply the fresh fixing liquid $LQ_3$ to the downstream side of the filter 424 to allow the fixing liquid $LQ_3$ to be absorbed well in the filter 424 in the second fixing subtank 42.

The fixing liquid $LQ_3$ flows from the downstream located second fixing subtank 42 to the upstream located first fixing subtank 41 to raise the liquid level of the first fixing tank 33 and the first fixing subtank 41 with the result that the fixing liquid $LQ_3$ in the first fixing tank 33 is drained into the drainage tank 50 through the drainage pipe 501. As a result, the fixing liquid $LQ_3$ in the first fixing tank 33 and the second fixing tank 34 is constantly set at a predetermined condition for fixing.

Since the bleaching liquid $LQ_2$ having a greater specific gravity than the fixing liquid $LQ_3$is adhered to the surface of the film F in the bleaching process and carried into the first fixing tank 33 and the first fixing subtank 41, the fixing liquid $LQ_3$ in the first fixing tank 33 and the first fixing subtank 41 has a heavier specific gravity than the fixing liquid $LQ_3$ in the second fixing tank 34 and the second fixing subtank 42. However, the lighter fixing liquid $LQ_3$ flowing from the second fixing subtank 42 is guided downward in the first fixing subtank 41 by the guide member 54 to be mixed well with the heavier fixing liquid $LQ_3$ in the first fixing subtank 41.

When the first stabilizing liquid pump 436, the second stabilizing liquid pump 446, the third stabilizing liquid pump 456, and the fourth stabilizing liquid pump 582 are activated, the stabilizing liquid $LQ_4$ in the first stabilizing subtank 43, the second stabilizing subtank 44, and the third stabilizing subtank 45 are respectively supplied to the first stabilizing tank 35, the second stabilizing tank 36, and the third stabilizing tank 37 while having particles and other foreign matters removed through the filters 434, 444, 454 respectively. Thereby, the stabilizing liquid $LQ_4$ circulates in the first stabilizing subtank 43 and the first stabilizing tank 35, the second stabilizing subtank 44 and the second stabilizing tank 36, and the third stabilizing subtank 45 and the third stabilizing tank 37, respectively.

On the other hand, fresh stabilizing liquid $LQ_4$ is continuously (or intermittently) replenished from the replenish tank 58 to the third stabilizing subtank 45. Thereby, the liquid level of the third stabilizing tank 37 and the third stabilizing subtank 45 is raised, and the stabilizing liquid $LQ_4$ overflows from the downstream located third stabilizing subtank 45 into the upstream located second stabilizing subtank 44 through the liquid channel 441*a* formed in the partition wall 441. The stabilizing liquid $LQ_4$ is guided downward in the second stabilizing subtank 44 by the guide member 58 with the result that the downward guided liquid $LQ_4$ mixes with the stabilizing liquid $LQ_4$ in the second stabilizing subtank 44. Further, the stabilizing liquid $LQ_4$ guided downward in the second stabilizing subtank 44 by the guide member 58 is supplied to the second stabilizing tank 36 through the filter 444. Accordingly, the stabilizing liquid $LQ_4$ assuredly mixes with the stabilizing liquid $LQ_4$ in the second stabilizing tank 36.

In the case of supplying fresh stabilizing liquid $LQ_4$ from the replenish tank 58 to the third stabilizing subtank 45, it may be preferable to supply the fresh stabilizing liquid $LQ_4$ to the downstream side of the filter 454 to allow the stabilizing liquid $LQ_4$ to be absorbed well in the filter 454 in the third stabilizing subtank 45.

The stabilizing liquid $LQ_4$ flows from the downstream located third stabilizing subtank 45 to the upstream located second stabilizing subtank 44 to raise the liquid level of the second stabilizing tank 36 and the second stabilizing subtank 44 with the result that the stabilizing liquid $LQ_4$ in the downstream located second stabilizing subtank 44 flows into the upstream located first stabilizing subtank 43 through the liquid channel 431*a* formed in the partition wall 431. The stabilizing liquid $LQ_4$ is guided downward in the first stabilizing subtank 43 by the guide member 56 with the result that the downward guided liquid $LQ_4$ mixes with the stabilizing liquid $LQ_4$ in the first stabilizing subtank 43. Further, the stabilizing liquid $LQ_4$ guided downward in the first stabilizing subtank 43 by the guide member 56 is supplied to the first stabilizing tank 35 through the filter 434. Accordingly, the stabilizing liquid $LQ_4$ assuredly mixes with the stabilizing liquid $LQ_4$in the first stabilizing tank 35.

The stabilizing liquid $LQ_4$ flows from the downstream located second stabilizing subtank 44 to the upstream located first stabilizing, subtank 43 to raise the liquid level of the first stabilizing tank 35 and the first stabilizing subtank 43 with the result that the stabilizing liquid $LQ_4$ in the first stabilizing tank 35 is drained into the drainage tank 55 through the drainage pipe 551. As a result, the stabilizing liquid $LQ_4$ in the first stabilizing tank 35, the second stabilizing tank 36, and the third stabilizing tank 37 is constantly set at a predetermined condition for stabilizing.

Since the fixing liquid $LQ_3$ having a greater specific gravity than the stabilizing liquid $LQ_4$ is adhered to the surface of the film F in the fixing process and carried into the first stabilizing tank 35 and the first stabilizing subtank 43, the stabilizing liquid $LQ_4$ in the first stabilizing tank 35 and the first stabilizing subtank 43 has a heavier specific gravity than the stabilizing liquid $LQ_4$ in the second stabilizing tank 36 and the second stabilizing subtank 44. However, the lighter stabilizing liquid $LQ_4$ flowing from the second stabilizing subtank 44 is guided downward in the first stabilizing subtank 43 by the guide member 56 to be mixed well with the heavier stabilizing liquid $LQ_4$ in the first stabilizing subtank 43.

Further, since the stabilizing liquid $LQ_4$ having a greater specific gravity than that in the second stabilizing tank 36 and the second stabilizing subtank 44 is carried therein along with the feeding of the film F on which the heavier stabilizing liquid $LQ_4$ is adhered, the stabilizing liquid $LQ_4$ in the second stabilizing tank 36 and the second stabilizing subtank 44 has a specific gravity heavier than the stabilizing liquid $LQ_4$ in the third stabilizing tank 37 and the third stabilizing subtank 45. However, the lighter stabilizing liquid $LQ_4$ flowing from the third stabilizing subtank 45 is guided downward in the second stabilizing subtank 44 by the guide member 58 to be mixed well with the heavier stabilizing liquid $LQ_4$ in the second stabilizing subtank 44.

The concentration of each of the treating liquids is increased due to evaporation of water in the treating liquid owning to a continuous use of the system for a prolonged time. Accordingly, a concentration sensor is provided in each of the subtanks 39, 40, 42, and 45 where the respective replenish tanks 46, 48, 51, and 58 are provided to automatically supply water when a detected concentration exceeds a predetermined level. The description of the concentration sensor is omitted herein.

The following modifications and alterations can be applied to this invention.

(1) In the above embodiment, the treating liquid is guided downward in the subtanks 41, 43, 44 through the liquid channels 441*a*, 431*a*, 441*a* by the guide members 54, 56, 58, respectively. Alternatively, if the liquid channel 441*a* (431*a*, 441*a*) is formed near the filter 414 (434, 444), the guide member 54 (56, 58) may be omitted.

In such a case, the treating liquid flowing through the liquid channel 441*a* (431*a*, 441*a*) is supplied to the treating tank 33 (35, 36) while being absorbed in the filter 414 (434, 444). Accordingly, the treating liquid mixes well with the treating liquid that has been in the subtank 41 (43, 44) with a different specific gravity.

More specifically, the position near the filter 414 (434, 444) is a position where the treating liquid flowing through the liquid channel 441*a* (431*a*, 441*a*) is efficiently absorbed in the filter 414 (434, 444), e.g., a position where the liquid channel 441*a* (431*a*, 441*a*) opposes to the filter 414 (434, 444) (in the case where the filter is disposed in the middle of the subtank, the corresponding liquid channel is formed in the middle of the upper end of the partition wall).

(2) In the above embodiment, the subtanks 39, 40, 41, 42, 43, 44, and 45 are integrally formed with each other via the partition walls 391, 401, 411, 421, 431, and 441, respectively, and part of the upper end of the partition walls 411, 431, and 441 is cut out to form the liquid channels 441*a*, 431*a*, 441*a*, respectively. Alternatively, the subtanks 39, 40, 41, 42, 43, 44, and 45 may be individually formed. In such a case, an upper end of a wall part of the adjacent subtanks is cut out, and a passage in the form of a gutter may be mounted between the adjacent cutaways.

(3) In the above embodiment, the liquid channel 441*a* (431*a*, 441*a*) is formed at only one position of the corresponding partition wall. More than one liquid channel may be formed in the partition wall.

(4) In the foregoing embodiment, the projecting plate pair 411*b*, 411*c* (431*b*, 431*c*; 441*b*, 441*c*) and the opposing plate 411*d* (431*d*, 441*d*) constitute the guide member 54 (56, 58). The guide member may be a single tubular member. Alternatively, the projecting plate pair 411*b*, 411*c* (431*b*, 431*c*; 441*b*, 441*c*) may be omitted, and the guide member 54 (56, 58) may consist of the opposing plate 411*d* (431*d*, 441*d*). In such a case, the opposing plate 411*d* (431*d*, 441*d*) may be arranged at least at such a position as to oppose to the partition wall 411 (431, 441) at a lower position of the liquid channel 441*a* (431*a*, 441*a*). Also, in the above case, the opposing plate 411*d* (431*d*, 441*d*) may be a flat plate without the side plates 411*e*, 411*f* (434*e*, 431*f*; 441*e*, 441*f*) or have a curved surface in its entirety.

The guide member 54 (56, 58) may consist of the projecting plate pair 411*b*, 411*c* (431*b*, 431*c*; 441*b*, 441*c*) and a flat opposing plate 411*d* (431*d*, 441*d*) without the side plates 411*e*, 411*f* (4341*e*, 431*f*; 441*e*, 441*f*). As an altered form, the guide member 54 (56, 58) may be set in a tilted state to guide the treating liquid flowing from the downstream located subtank obliquely toward the filter 414 (434, 444) as well as the downward guiding.

(5) In the above embodiment, the first fixing tank 33, the first fixing subtank 41, the second fixing tank 34, and the second fixing subtank 42 are so constructed as to set the liquid level thereof equal to one another. As an altered arrangement, the drainage pipe 501 of the first fixing tank 33 may be set at a lower position to set the liquid level of the first fixing tank 33 and the first fixing subtank 41 lower than the second fixing tank 34 and the second fixing subtank 42. In such a case, a gap is generated between the liquid level of the first fixing subtank 41 and the second fixing subtank 42 to flow the treating liquid rapidly from the second fixing subtank 42 to the first fixing subtank 41, thereby enhancing the mixing of the treating liquids with a different specific gravity.

(6) In the above embodiment, the first stabilizing tank 35, the first fixing subtank 43, the second stabilizing tank 36, the second stabilizing subtank 44, the third stabilizing tank 37, and the third stabilizing subtank 45 are constructed to set the liquid level thereof equal to one another. Alternatively, the drainage pipe 551 of the first stabilizing tank 35 may be set at a lower position to set the liquid level of the first stabilizing tank 35 and the first stabilizing subtank 43 lower than the second stabilizing tank 36 and the second stabilizing subtank 44. Further, the liquid channel 431*a* between the first fixing subtank 43 and the second stabilizing subtank 44 may be set lower than the liquid channel 441*a* between the second stabilizing subtank 44 and the third stabilizing subtank 45 to set the liquid level of the second stabilizing tank 36 and the second stabilizing subtank 44 lower than the third stabilizing tank 37 and the third stabilizing subtank 45. In such a case, a gap is generated between the liquid level of the second stabilizing subtank 44 and the third stabilizing subtank 45 to flow the treating liquid rapidly from the third stabilizing subtank 45 to the second stabilizing subtank 44, thereby enhancing the mixing of the treating liquids with a different specific gravity.

(7) In the foregoing embodiment, the automatic developing system is described in the case of developing a film as a photographic sensitized material. This system is also applicable to a developing operation of photographic printing paper. Also, this system is applicable to an arrangement having the function of developing a film and photographic printing paper.

As described above, this invention is directed to an automatic developing system of developing a photographic sensitized material provided with a first treating tank and a second treating tank each filled with the same kind of treating liquid therein and arranged sequentially from an upstream side to a downstream side in a feeding direction of the sensitized material, a first subtank and a second subtank each filled with the same kind of treating liquid as the first treating tank and the second treating tank therein and communicating with the first treating tank and the second treating tank, respectively side by side, a supplier means for supplying the treating liquid in each of the first subtank and the second subtank to the corresponding treating tank via a filter provided in the subtank, and a liquid channel formed between the first subtank and the second subtank to flow the treating liquid from the second subtank into the upstream first subtank therethrough by replenishing fresh treating liquid from an external source into the downstream second subtank, wherein the liquid channel is formed in an upper end between the first subtank and the second subtank, near the filter in the first subtank.

Further, according to another aspect of this invention, this invention is directed to an automatic developing system of developing a photographic sensitized material provided with a first treating tank and a second treating tank each filled with the same kind of heating liquid therein and arranged sequentially from an upstream side to a downstream side in a feeding direction of the sensitized material, a first subtank and a second subtank each filled with the same kind of treating liquid as the first treating tank and the second treating tank therein and communicating with the first treating tank and the second treating tank, respectively side by side, a liquid channel formed between the first subtank and the second subtank to flow the treating liquid from the second subtank into the upstream first subtank therethrough by replenishing fresh treating liquid from an external source into the downstream second subtank, wherein the liquid channel is formed in an upper end between the first subtank and the second subtank, and the first subtank is internally provided with a guide member for guiding the treating liquid flowing into the first subtank from the second subtank through the liquid channel downward.

In the above arrangements, there can be eliminated a construction of the conventional system in which the through hole is formed in the vertically intermediate portion of the partition wall between the adjacent subtanks and the liquid supply pipe is provided in the through hole. Accordingly, obtained is an automatic developing system of developing a photographic sensitized material that can securely mix the lighter treating liquid flowing from the downstream located subtank to the upstream located subtank with the heavier treating liquid with a simplified construction. Further, in the case of integral molding of the treating tank and the subtank with a synthetic resin or its equivalent, there can be eliminated a construction of the conventional system in which the through hole is formed in the vertically intermediate portion of the partition wall between the adjacent subtanks and the liquid supply pipe is provided in the through hole. Accordingly, the structure of the mold can be simplified, thereby reducing the production cost of the system.

According to another aspect of this invention, the first subtank and the second subtank may be provided sequentially via a partition wall, and the liquid channel may be a cutaway formed in the partition wall.

In this arrangement, the treating liquid having a smaller specific gravity in the downstream located second subtank flows into the upstream located first subtank through the cutaway formed in the upper end of the partition wall. When the lighter treating liquid flows in the first subtank, the treating liquid is supplied to the corresponding treating tank while being absorbed in the filter with the heavier treating liquid in the first subtank. Consequently, the lighter treating liquid mixes well with the heavier treating liquid.

According to yet another aspect of this invention, the partition wall may be formed on the side of the first subtank with an upright first bank including a pair of guide portions at a lower position on lateral ends of the cutaway.

In this arrangement, the first bank suppresses diffusion of the treating liquid that has flowed through the liquid channel into the first subtank in the sideways direction. Thereby, the treating liquid is efficiently guided downward in the first subtank.

According to still another aspect of this invention, the guide member may include an opposing plate arranged at such a position as to oppose to the partition wall at least at a lower position of the cutaway.

In this arrangement, the treating liquid having a smaller specific gravity flows from the downstream located second subtank to the upstream located first subtank through the cutaway and is guided downward in the first subtank while being blocked by the opposing plate. Accordingly, the lighter treating liquid mixes well with the heavier treating liquid in the first subtank. Further, this arrangement simplifies the construction inside the first subtank.

According to a further aspect of this invention, the opposing plate may be formed with an upright second bank including a pair of guide portions on lateral ends thereof.

In this arrangement, the second bank suppresses diffusion of the treating liquid that has flowed through the liquid channel into the first subtank in the sideways direction. Thereby, the treating liquid is efficiently guided downward in the first subtank.

According to yet another aspect of this invention, the partition wall may be formed on the side of the first subtank with a first upright bank including a pair of guide portions at a lower position on lateral ends of the cutaway, and the pair of guide portions of the second bank may be so formed as to encompass the pair of guide portions of the first bank.

In this arrangement, the first bank suppresses diffusion of the treating liquid that has flowed through the liquid channel into the first subtank in the sideways direction. Further, the treating liquid is efficiently guided downward in the first subtank along a passage defined between the first bank and the second bank.

According to still another aspect of this invention, the first subtank may have an opening opened upward and a cover to cover the opening, and the opposing plate may be formed integral with the cover.

In this arrangement, when the cover is mounted on the opening of the first subtank, the opposing plate formed integral with the cover is set at such a position as to oppose to the cutaway formed in the partition wall. Thereby, merely mounting the cover on the opening secures setting the opposing plate at the predetermined position.

EXPLOITATION IN INDUSTRY

According to an automatic developing system of developing a photographic sensitized material of this invention, a liquid channel is formed in an upper end between an upstream located first subtank and a downstream located second subtank near a filter in the first subtank. Thereby, a treating liquid with a smaller specific gravity that flows from the downstream second subtank into the upstream first subtank can be securely mixed with a treating liquid with a greater specific gravity with a simplified construction.

In addition, a guide member is provided in the upstream located first subtank to guide the treating liquid that has flowed from the downstream located second subtank into the upstream located first subtank through the liquid channel downward. Accordingly, the lighter treating liquid that has flowed from the downstream located second subtank into the upstream located first subtank can be securely mixed with the heavier treating liquid in the first subtank.

We claim:

1. An automatic developing system of developing a photographic sensitized material provided with a first treating tank and a second treating tank each filled with the same kind of treating liquid therein and arranged sequentially from an upstream side to a downstream side in a feeding direction of the sensitized material, a first subtank and a second subtank each filled with the same kind of treating liquid as the first treating tank and the second treating tank therein and communicating with the first treating tank and the second treating tank, respectively side by side, a supplier means for supplying the treating liquid in each of the first subtank and the second subtank to the corresponding treating tank via a filter provided in the subtank, and a liquid channel formed between the first subtank and the second subtank to flow the treating liquid from the second subtank into the upstream first subtank therethrough by replenishing fresh treating liquid from an external source into the downstream second subtank, the system characterized in that the liquid channel is formed in an upper end between the first subtank and the second subtank, near the filter in the first subtank.

2. The automatic developing system as set forth in claim 1, wherein the first subtank and the second subtank are provided sequentially via a partition wall, and the liquid channel includes a cutaway formed in the partition wall.

3. An automatic developing system of developing a photographic sensitized material provided with a first treating tank and a second treating tank each filled with the same kind of treating liquid therein and arranged sequentially from an upstream side to a downstream side in a feeding direction of the sensitized material, a first subtank and a second subtank each filled with the same kind of treating liquid as the first treating tank and the second treating tank therein and communicating with the first treating tank and the second treating tank, respectively side by side, a liquid channel formed between the first subtank and the second subtank to flow the treating liquid from the second subtank into the upstream first subtank therethrough by replenishing fresh treating liquid from an external source into the downstream second subtank, the system characterized in that the liquid channel is formed in an upper end between the first subtank and the second subtank, and the first subtank is internally provided with a guide member for guiding the treating liquid flowing into downward of the first subtank from the second subtank through the liquid channel.

4. The automatic developing system as set forth in claim 3, wherein the first subtank and the second subtank are provided sequentially via a partition wall, and the liquid channel includes a cutaway formed in the partition wall.

5. The automatic developing system as set forth in claim 4, wherein the partition wall is formed with an upright first bank including a pair of guide portions at a lower position on lateral ends of the cutaway oil the side of the first subtank.

6. The automatic developing system as set forth in claim 4, wherein the guide member includes an opposing plate arranged at such a position as to oppose to the partition wall at least at a lower position of the cutaway.

7. The automatic developing system as set forth in claim 6, wherein the opposing plate is formed with an upright second bank including a pair of guide portions on lateral ends thereof.

8. The automatic developing system as set forth in claim 7, wherein the partition wall is formed with a first upright bank including a pair of guide portions at a lower position on lateral ends of the cutaway on the side of the first subtank, and the pair of guide portions of the second bank are so formed as to encompass the pair of guide portions of the first bank.

9. The automatic developing system as set forth in any of claims 6 to 8, wherein the first subtank has an opening opened upward and a cover to cover the opening, and the opposing plate is formed integral with the cover.

* * * * *